US006363561B1

(12) United States Patent
Chang

(10) Patent No.: US 6,363,561 B1
(45) Date of Patent: Apr. 2, 2002

(54) MULTI-FUNCTION TOOL

(76) Inventor: Chung-Shu Chang, No. 24, Lane 520, Chung Der Road Sec. 1, Taichung (TW)

( * ) Notice: Subject to any disclaimer, the term of this patent is extended or adjusted under 35 U.S.C. 154(b) by 0 days.

(21) Appl. No.: 09/729,564

(22) Filed: Dec. 4, 2000

(51) Int. Cl.[7] ..... B25B 13/10
(52) U.S. Cl. ..... 7/142; 7/158; 81/177.9
(58) Field of Search ..... 7/142, 158, 168; 81/177.2, 177.6, 177.8, 177.9

(56) References Cited

U.S. PATENT DOCUMENTS 6,186,034 B1 * 2/2001 Lamons ..... 81/177.9

* cited by examiner

*Primary Examiner*—Joseph J. Hail, III
*Assistant Examiner*—David Thomas
(74) *Attorney, Agent, or Firm*—Charles E. Baxley

(57) ABSTRACT

A tool includes a handle and a frame is disengagably connected to the handle. A head having a wrench device is pivotally connected to the frame and a hammer piece is connected to the head. The frame has two arms and each arm having a plurality of apertures and the head has a ball extending from each one of two sides thereof so as to be engaged with one of the apertures. The handle has a blade slidably received therein and can be extended from the handle when the head and the frame are removed from the handle.

9 Claims, 6 Drawing Sheets

MULTI-FUNCTION TOOL

FIELD OF THE INVENTION

The present invention relates to a tool having multiple functions and can be separated into two parts for convenience of storage.

BACKGROUND OF THE INVENTION

A conventional multi-function tool is shown in FIG. 5 and generally includes a handle 50 with an adjustable wrench means 51 connected to the handle 50. An adjustable screw 53 is connected to the other end of the adjustable wrench 51 and can be used as a hammer. A pivot is used to pivotally connect the handle 50 and the two adjustable wrench means 51 and screw 53. However, the adjustable screw 53 is likely damaged if it is used as a hammer and the total length of the tool is too long to be easily received. Besides, only limited functions can be used for this tool. Another conventional multi-function tool is shown in FIG. 6 and generally includes a handle 500 and a wrench means 510 connected to the handle 500. This conventional tool does provide a solution for the shortcomings mentioned above.

The present invention intends to provide a multi-function tool which includes different types of tools and can be separated into two parts.

SUMMARY OF THE INVENTION

In accordance with one aspect of the present invention, there is provided a tool and comprising a handle and a frame disengagably connected to the handle. A head has a wrench device and is pivotally connected to the frame and a hammer piece is connected to the head. The frame has two arms and each arm has a plurality of apertures and the head has a ball extending from each one of two sides thereof so as to be engaged with one of the apertures. The handle has tools pivotally or slidably connected thereto.

The primary object of the present invention is to provide a tool that is composed of two parts and involves multiple functions.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
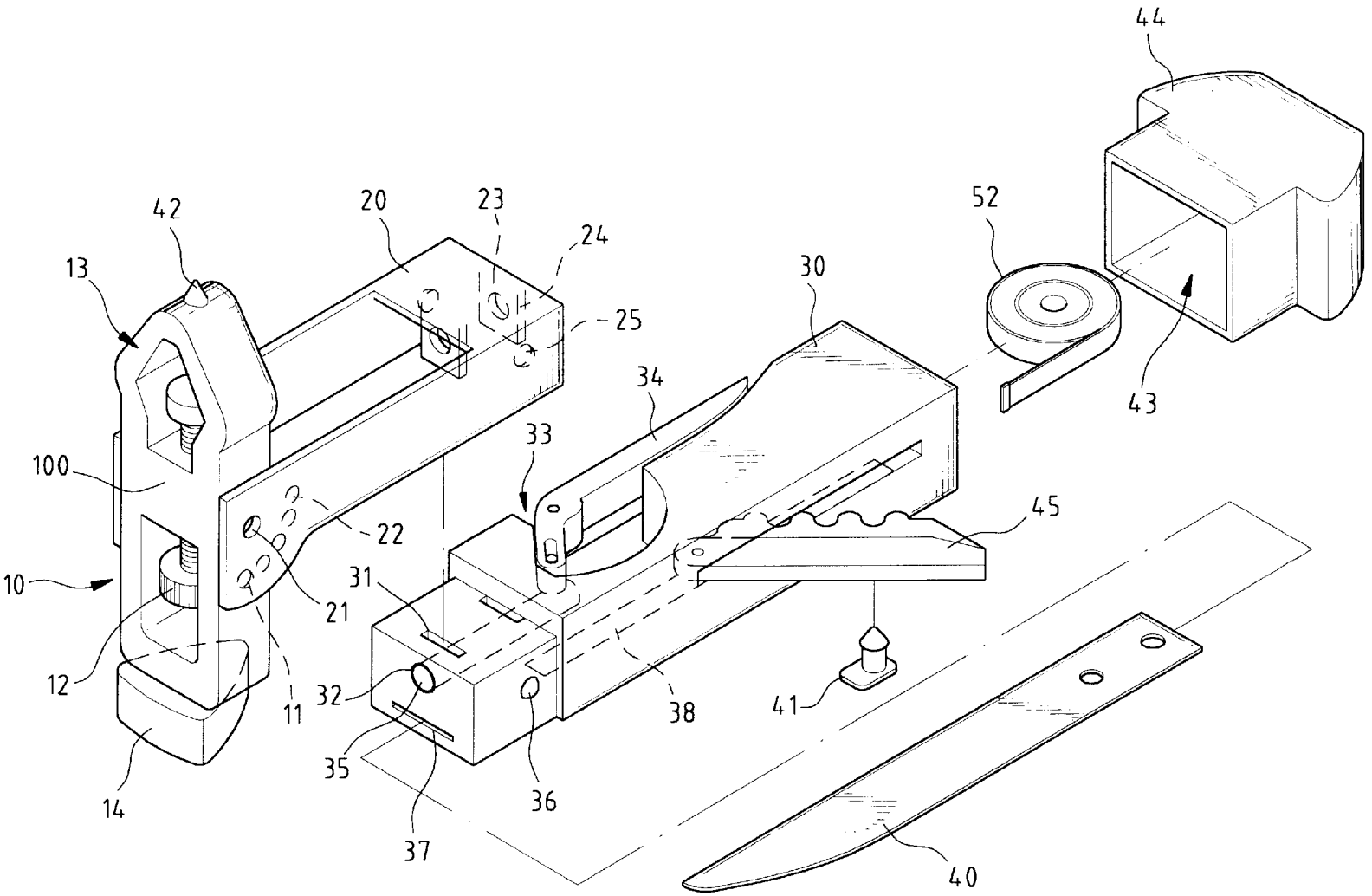
FIG. 1 is an exploded view to show a tool of the present invention.
Figure 2:
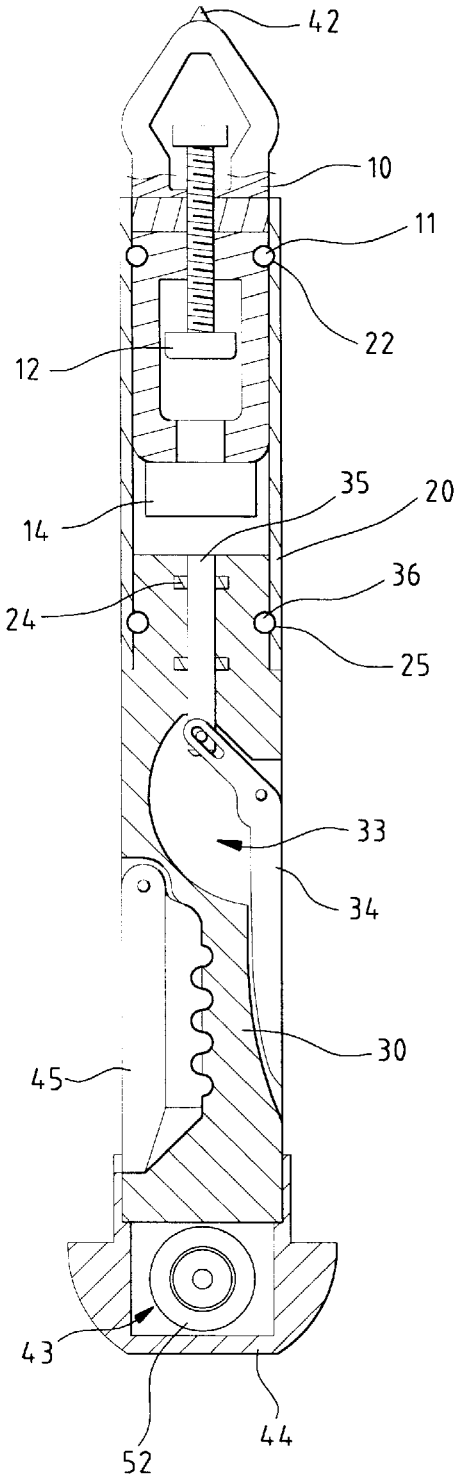
FIG. 2 is a cross sectional view to show the tool of the present invention.
Figure 3:
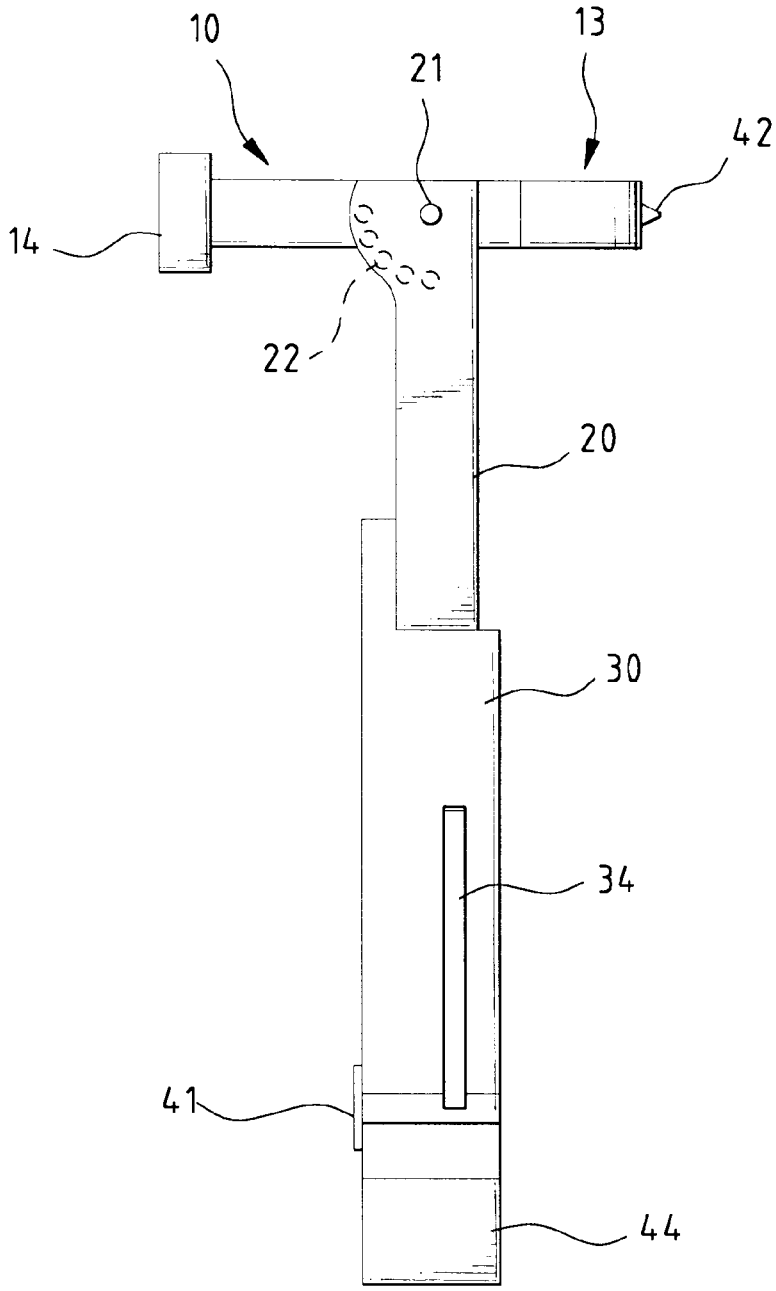
FIG. 3 is a side elevational view to show the tool of the present invention.

Referring to FIGS. 1 and 2, the tool of the present invention comprises a handle 30 and a frame 20 having two arms is disengagably connected to a first end of the handle 30. Each arm has a plurality of apertures 22 defined therethrough and a head 10 is pivotally connected between the two arms at the position 21. A first ball 11 extends from each one of two sides of the head 10 so as to be engaged with one of the apertures 22 so that the head 10 can be positioned at an angle relative to the two arms. As shown in FIGS. 2 and 3, the head 10 may be positioned in two positions which are in alignment with the handle 30 or perpendicular to the handle 30. Two spaces are defined in the head 10 and is separated by a rib 100. Two adjustable screws 12 are located in the two spaces and engaged with the rib 100 so that an object such as a bolt head or nut can be clamped between the inner periphery defining each space and the adjustable screws 12. Therefore, the head 10 is used as a wrench by rotating the handle 30. A hammer piece 14 is connected to a first end of the head 10 and a cone-shaped member 42 is connected to a second end of the head 10. The second end of the head 10 is a triangular end 13 which is advantageously to be used as a sharp-ended hammer together with the cone-shaped member 42.

Two plates 24 extend from the frame 20 and each plate 24 has a hole 23. Two positioning holes 25 are respectively defined through two sides of the frame 20. A top surface of the first end of the handle 30 has two first slots 31 for receiving the two plates 24 therein. A pin 35 is movably connected to the handle 30 and extends through the holes 23 of the plates 24 to connect the frame 20 and the handle 30. A hole 32 and a slit 37 are respectively defined through an end surface of the first end of the handle 30 so that the pin 35 may extend through the hole 32. A second ball 36 extends from each one of two sides of the first end of the handle 30 so that the second balls 36 are engaged with the two positioning holes 25 to provide further positioning function of the frame 20 and the handle 30.

Figure 4:
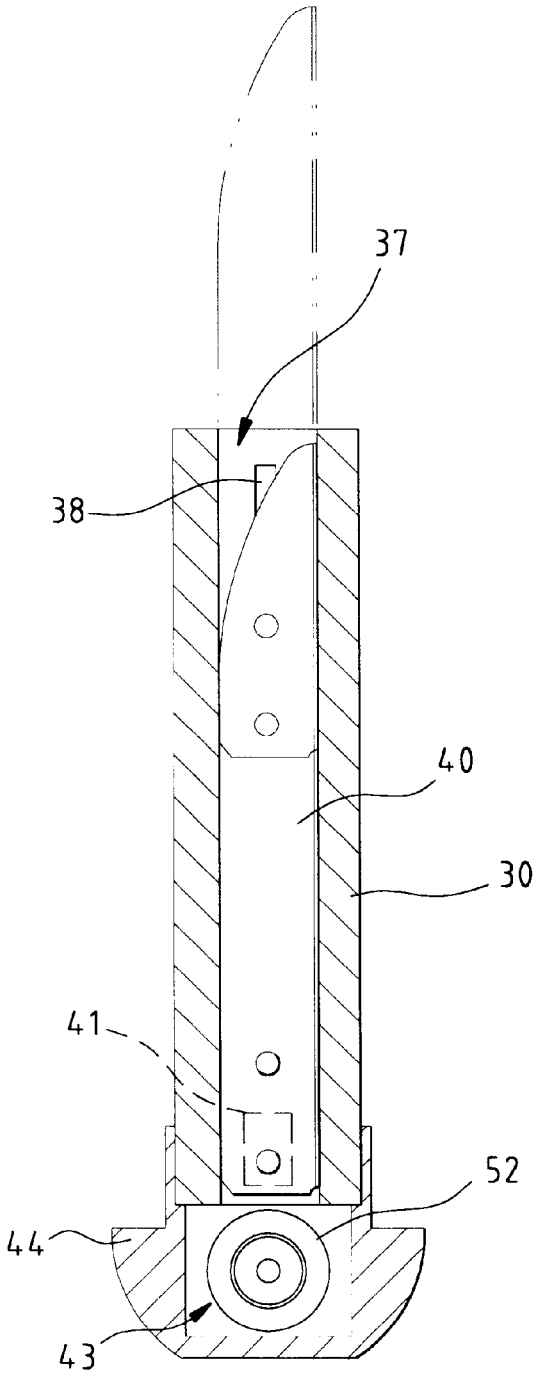
FIG. 4 is a cross sectional view to show a blade is slidably extended from the handle of the tool of the present invention.
Figure 5:
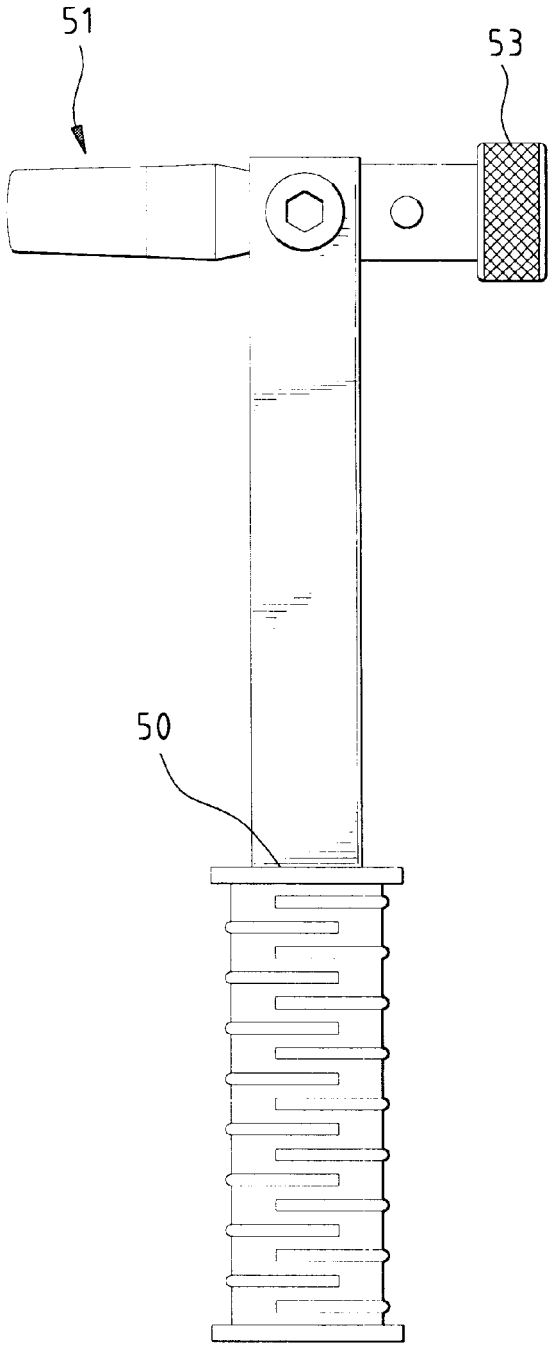
FIG.5 PRIOR ART
FIG. 5 is a side elevational view to show a conventional tool.
Figure 6:
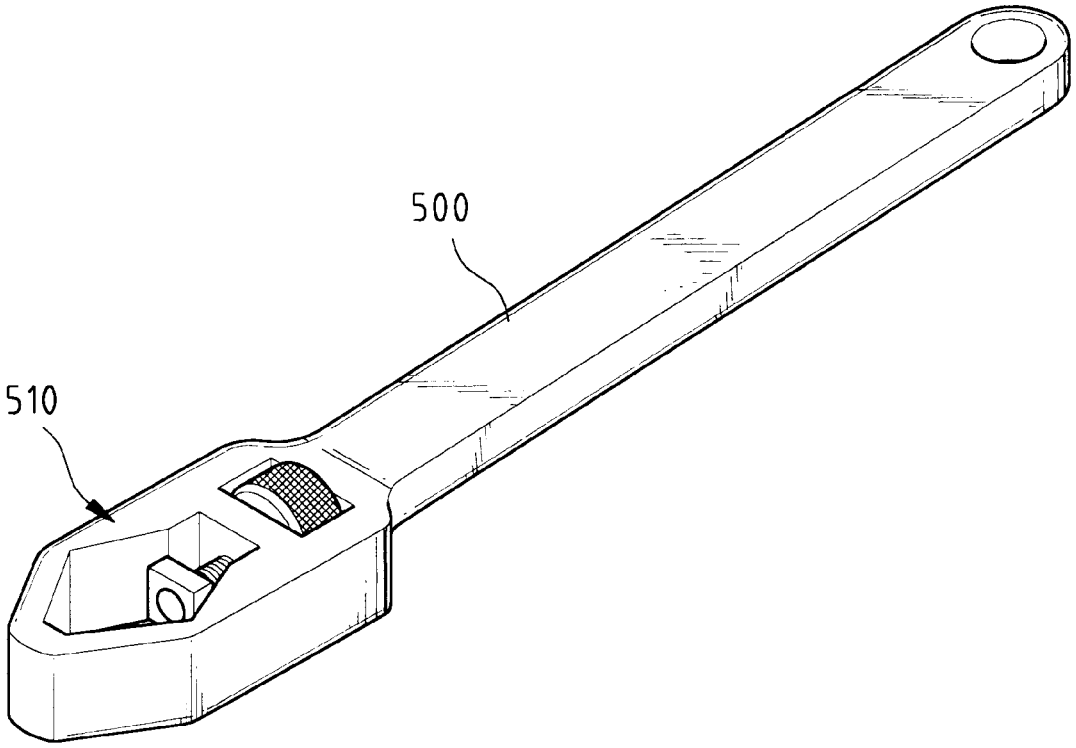
FIG.6 PRIOR ART
FIG. 6 is a perspective view to show another conventional tool.

A recess 33 is defined in a first side of the handle 30 and a lever 34 is pivotally connected to the handle 30 and an end of the lever 34 is pivotally located in the recess 33. The pin 35 is connected to the end of the lever 34 in the recess 33 so that when pulling the lever 34 away from the handle 30, the pin 35 is disengaged from the two holes 23 of the plates 24, and the frame 20 is able to be disconnected from the handle 30. A groove 38 is defined through a bottom surface of the handle 30 and a blade 40 is received in the handle 30 via the slit 37. A push member 41 is movably engaged with the groove 38 and connected to an end of the blade 40 so that the other end of the blade 40 may extend through the slit 37 by pushing the push member 41 when the frame 20 is removed from the handle 30 as shown in FIG. 4. A tool 45 such as a saw is pivotally received in a side of the handle 30. An end cap 44 is mounted to a second end of the handle 30 and the end cap 44 has a receiving space 43 defined therein so as to receive a measure device 52 or bits.

The tool involves different types of functions and can be separated into two parts which are convenient for storage.

While we have shown and described various embodiments in accordance with the present invention, it should be clear to those skilled in the art that further embodiments may be made without departing from the scope and spirit of the present invention.

What is claimed is:

1. A tool comprising:

a handle, and a frame disengagably connected to a first end of said handle and a head pivotally connected to said frame, said frame having two arms and each arm having a plurality of apertures, said head pivotally connected between said two arms and a first ball extending from each one of two sides of said head so as to be engaged with one of said apertures.

2. The tool as claimed in claim 1, wherein said head has a hammer piece connected to a first end thereof and two spaces are defined in said head and separated by a rib, two adjustable screws located in said two spaces and engaged with said rib.

3. The tool as claimed in claim 2, wherein a cone-shaped member is connected to a second end of said head.

4. The tool as claimed in claim 1 further comprising two plates extending from said frame and each plate having a hole, said surface of said first end of said handle having two first slots so as to receive said two plates therein, a pin movably connected to said handle and extending through said holes of said plates to connect said frame and said handle.

5. The tool as claimed in claim 4 further comprising a second ball extending from each one of two sides of said first end of said handle and two positioning holes respectively defined through two sides of said frame, said second balls engaged with said two positioning holes.

6. The tool as claimed in claim 4 further comprising a recess defined in a first side of said handle and a lever pivotally connected to said handle and located in said recess, said pin connected to an end of said lever in said recess.

7. The tool as claimed in claim 1 further comprising a slit defined through an end surface of said first end of said handle and a groove defined through said handle, a blade received in said handle and a push member movably engaged with said groove and connected to an end of said blade, the other end of said blade extending through said slit.

8. The tool as claimed in claim 1 further comprising a tool pivotally received in a side of said handle.

9. The tool as claimed in claim 1 further comprising an end cap mounted to a second end of said handle, said end cap having a receiving space defined therein.

* * * * *